US010204485B2

(12) United States Patent
Korthauer et al.

(10) Patent No.: US 10,204,485 B2
(45) Date of Patent: Feb. 12, 2019

(54) GAMING SYSTEMS, GAMING DEVICES AND METHODS FOR INCREMENTING PROGRESSIVE JACKPOTS

(71) Applicant: Bally Gaming, Inc., Las Vegas, NV (US)

(72) Inventors: Jeffrey S. Korthauer, Chicago, IL (US); Jeffry L. Nauman, Yorkville, IL (US); Yashpal Y. Patel, Arlington Heights, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 567 days.

(21) Appl. No.: 15/010,124

(22) Filed: Jan. 29, 2016

(65) Prior Publication Data

US 2016/0232752 A1 Aug. 11, 2016

(51) Int. Cl.
*G07F 17/32* (2006.01)

(52) U.S. Cl.
CPC ..... *G07F 17/3258* (2013.01); *G07F 17/3269* (2013.01)

(58) Field of Classification Search
CPC ..... G07F 17/34
See application file for complete search history.

(56) References Cited

U.S. PATENT DOCUMENTS 4,837,728 A 6/1989 Barrie
5,249,800 A 10/1993 Hilgendorf
5,855,515 A 1/1999 Pease
5,885,158 A 3/1999 Torango
6,004,207 A 12/1999 Wilson
6,224,482 B1 5/2001 Bennett
6,776,715 B2 8/2004 Price
7,361,088 B2 4/2008 Maya
7,578,740 B2 8/2009 Marks
7,601,060 B2 10/2009 Baerlocher
7,651,392 B2 1/2010 Pennington
7,736,226 B1 6/2010 Luciano
7,753,784 B2 7/2010 Baerlocher
7,850,524 B2 12/2010 Jackson
7,862,427 B2 1/2011 Nguyen
7,883,410 B2 2/2011 Soukup
7,914,377 B2 3/2011 Benbrahim
(Continued)

*Primary Examiner* — Robert T Clarke, Jr.
(74) *Attorney, Agent, or Firm* — Nixon Peabody LLP

(57) ABSTRACT

Presented herein are gaming systems, gaming machines, and methods for conducting wagering games. Gaming machines are disclosed which include a gaming cabinet, display device(s) and input device(s) coupled to the cabinet, and game-logic circuitry disposed within the cabinet. Game-logic circuitry is configured to: display on the display device a jackpot value of a progressive jackpot in a progressive jackpot meter; determine a meter speed for the progressive jackpot meter to incrementally display the jackpot value increase to a second jackpot value within a set time; determine a controlled meter position from the meter speed; determine a scroll speed for the controlled meter position; determine a respective scroll speed for each meter position to the right of the controlled meter position; display on the display device the progressive jackpot meter increasing to the second jackpot value as restricted by the first speed of scroll and any respective speeds of scroll.

20 Claims, 7 Drawing Sheets

(56) References Cited

U.S. PATENT DOCUMENTS

| | | | | |
|---|---|---|---|---|
| 7,934,993 | B2 | 5/2011 | Kuehling | |
| 7,963,846 | B2 | 6/2011 | Englman | |
| 7,988,552 | B2 | 8/2011 | Thomas | |
| 8,062,124 | B2 | 11/2011 | Jaffe | |
| 8,070,605 | B2 | 12/2011 | Tien | |
| 8,096,874 | B2 | 1/2012 | Nicely | |
| 8,137,180 | B2 | 3/2012 | Thomas | |
| 8,147,320 | B2 | 4/2012 | Englman | |
| 8,182,338 | B2 | 5/2012 | Thomas | |
| 8,197,330 | B2 | 6/2012 | Englman | |
| 8,251,803 | B2 | 8/2012 | Nelson | |
| 8,267,777 | B2 | 9/2012 | Jaffe | |
| 8,272,949 | B2 | 9/2012 | Dickerson | |
| 8,303,401 | B2 | 11/2012 | Yoshimura | |
| 8,328,626 | B2 | 12/2012 | Hornik | |
| 8,342,956 | B2 | 1/2013 | Anderson | |
| 8,353,753 | B2 | 1/2013 | Thomas | |
| 8,357,038 | B2 | 1/2013 | D'Amico | |
| 8,360,851 | B2 | 1/2013 | Aoki | |
| 8,376,841 | B2 | 2/2013 | Boesen | |
| 8,439,749 | B2 | 5/2013 | Anderson | |
| 8,449,387 | B2 | 5/2013 | Englman | |
| 8,449,388 | B2 | 5/2013 | Nicely | |
| 8,460,083 | B2 | 6/2013 | Joshi | |
| 8,506,391 | B2 | 8/2013 | Jaffe | |
| 8,512,132 | B2 | 8/2013 | Nicely | |
| 8,535,147 | B2 | 9/2013 | Ward | |
| 8,545,316 | B2 | 10/2013 | Pawloski | |
| 8,562,418 | B2 | 10/2013 | Gomez | |
| 8,591,324 | B2 | 11/2013 | Fitzsimons | |
| 8,628,410 | B2 | 1/2014 | Jaffe | |
| 8,641,499 | B2 | 2/2014 | Gomez | |
| 8,678,918 | B2 | 3/2014 | Cregan | |
| 8,684,832 | B2 | 4/2014 | Saffari | |
| 8,734,239 | B2 | 5/2014 | Kelly | |
| 8,740,710 | B2 | 6/2014 | Kelly | |
| 8,747,211 | B2 | 6/2014 | Vallejo | |
| 8,758,123 | B2 | 6/2014 | Frattinger | |
| 8,764,557 | B2 | 7/2014 | Schaefer | |
| 8,771,060 | B2 | 7/2014 | Reddicks | |
| 8,821,265 | B2 | 9/2014 | Englman | |
| 8,821,289 | B2 | 9/2014 | Green | |
| 8,851,982 | B2 | 10/2014 | Englman | |
| 8,888,577 | B2 | 11/2014 | Wolf | |
| 2003/0003989 | A1* | 1/2003 | Johnson | G07F 17/32 463/25 |
| 2003/0027625 | A1 | 2/2003 | Rowe | |
| 2005/0064930 | A1 | 3/2005 | Jubinville | |
| 2007/0060319 | A1 | 3/2007 | Block | |
| 2007/0298873 | A1 | 12/2007 | Nguyen | |
| 2008/0020831 | A1 | 1/2008 | Ikehara | |
| 2008/0108430 | A1 | 5/2008 | Evans | |
| 2008/0108431 | A1 | 5/2008 | Cuddy | |
| 2008/0153587 | A1* | 6/2008 | Yoshimura | G07F 17/3258 463/27 |
| 2008/0194312 | A1 | 8/2008 | Nelson | |
| 2009/0042643 | A1 | 2/2009 | Gagner | |
| 2009/0124362 | A1 | 5/2009 | Cuddy | |
| 2009/0124364 | A1 | 5/2009 | Cuddy | |
| 2009/0124391 | A1 | 5/2009 | Nelson | |
| 2009/0275400 | A1 | 11/2009 | Rehm | |
| 2010/0048284 | A1 | 2/2010 | Jaffe | |
| 2010/0113131 | A1 | 5/2010 | Aoki | |
| 2010/0124989 | A1 | 5/2010 | Englman | |
| 2010/0222138 | A1 | 9/2010 | Luciano, Jr. | |
| 2011/0111843 | A1 | 5/2011 | Nicely | |
| 2011/0111844 | A1 | 5/2011 | Anderson | |
| 2011/0124408 | A1 | 5/2011 | Ward | |
| 2011/0195773 | A1 | 8/2011 | Michaelson | |
| 2011/0207526 | A1 | 8/2011 | Kamano | |
| 2011/0263317 | A1 | 10/2011 | Marks | |
| 2012/0046098 | A1 | 2/2012 | Cuddy | |
| 2012/0108324 | A1 | 5/2012 | King | |
| 2012/0122531 | A1 | 5/2012 | Aoki | |
| 2012/0252562 | A1 | 10/2012 | Aoki | |
| 2013/0053135 | A1 | 2/2013 | King | |
| 2013/0065677 | A1 | 3/2013 | Baerlocher | |
| 2013/0090160 | A1 | 4/2013 | Iyer | |
| 2013/0178260 | A1 | 7/2013 | Baerlocher | |
| 2013/0203487 | A1 | 8/2013 | Baerlocher | |
| 2013/0225277 | A1 | 8/2013 | Hughes | |
| 2013/0237313 | A1 | 9/2013 | Filipour | |
| 2013/0244766 | A1 | 9/2013 | Jaffe | |
| 2013/0252724 | A1 | 9/2013 | Nicely | |
| 2013/0316783 | A1 | 11/2013 | Kendall | |
| 2013/0337904 | A1 | 12/2013 | De Waal | |
| 2014/0004932 | A1 | 1/2014 | Baerlocher | |
| 2014/0087858 | A1 | 3/2014 | Cuddy | |
| 2014/0094241 | A1 | 4/2014 | Guinn | |
| 2014/0094260 | A1 | 4/2014 | Cuddy | |
| 2014/0094266 | A1 | 4/2014 | Aoki | |
| 2014/0094291 | A1 | 4/2014 | Olive | |
| 2014/0094293 | A1 | 4/2014 | Nicely | |
| 2014/0171189 | A1 | 6/2014 | Guan | |
| 2014/0213348 | A1 | 7/2014 | Vasquez | |
| 2014/0228107 | A1 | 8/2014 | Larsen | |
| 2014/0274349 | A1 | 9/2014 | Spencer | |
| 2014/0287825 | A1 | 9/2014 | Baerlocher | |
| 2014/0329578 | A1 | 11/2014 | Caspers | |
| 2014/0342805 | A1 | 11/2014 | Lafky | |

* cited by examiner

GAMING SYSTEMS, GAMING DEVICES AND METHODS FOR INCREMENTING PROGRESSIVE JACKPOTS

CLAIM OF PRIORITY AND CROSS-REFERENCE TO RELATED APPLICATION

This application claims the benefit of priority to U.S. Provisional Patent Application No. 62/113,575, which was filed on Feb. 9, 2015, and is incorporated herein by reference in its entirety.

COPYRIGHT

A portion of the disclosure of this patent document contains materials which are subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to electronic wagering game devices, casino gaming systems, gaming networks, and methods for operating casino gaming machines and systems. More particularly, aspects of the present disclosure relate to systems, methods, and devices for executing wagering game platforms with progressive jackpots.

BACKGROUND

Electronic gaming machines (EGM), such as slot machines, video poker machines, and the like, have become a cornerstone of the gaming industry. Generally, the popularity of such machines with players is dependent on the likelihood (or perceived likelihood) of winning money at the machine and the entertainment value of the machine relative to other available gaming options. Where the available gaming options include a number of competing machines and the expectation of winning at each machine is roughly the same (or believed to be the same), players are typically attracted to the most entertaining and exciting machines. Shrewd operators consequently strive to employ technologically advanced gaming devices with the most entertaining and exciting game features and enhancements because such devices attract frequent play and hence increase profitability to the operator. Thus, gaming manufacturers continuously endeavor to develop advanced gaming machines with improved gaming enhancements that will attract frequent play and player loyalty through enhanced entertainment value to the player.

A significant technical challenge is to improve the operation of gaming apparatus and games played thereon, including the manner in which they leverage an underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

One concept that has been successfully employed to improve the operation of gaming devices and enhance the entertainment value of a wagering game is the concept of a "secondary" or "bonus" game that may be played in conjunction with a "primary" or "basic" game. The bonus game may comprise any type of game, either similar to or completely different from the basic game, which is entered upon the occurrence of a selected event or outcome during play of the basic game. Generally, bonus games provide a greater expectation of winning than the basic game and may also be accompanied with more attractive or unusual video displays and/or audio.

Another concept that has been employed to improve the operation of gaming devices and games played thereon is the use of progressive jackpots. In the gaming industry, a "progressive game" or "progressive jackpot" involves collecting coin-in data from participating gaming device(s), such as slot machines, contributing a percentage of that coin-in data to a jackpot amount, and awarding that jackpot amount to a player upon the occurrence of a jackpot-winning event. A jackpot-winning event typically occurs when a "progressive winning position" is achieved during game play at a participating gaming device. If the gaming device is a slot machine, a progressive winning position may, for example, correspond to alignment of progressive-jackpot-triggering reel symbols along an active payline. For video poker games, the progressive jackpot is oftentimes awarded only when a player is dealt a card combination with the highest payoff, e.g. a royal flush. The initial progressive jackpot is set to a predetermined minimum amount. This initial jackpot amount, however, progressively increases as players continue to play the gaming machine without winning the jackpot. The incremental growth of a progressive jackpot is typically displayed by a dedicated metering device. When the progressive jackpot is awarded, the jackpot amount is typically reset to the predetermined minimum amount.

In existing progressive games, there may be a single progressive jackpot or multiple progressive jackpots that may be awarded. A single EGM may contribute to and compete for a progressive jackpot or several EGM's can be linked together, e.g., over a local area network (LAN) or wide-area network (WAN), such that several players at several gaming machines contribute to and compete for the same jackpot. Conventionally, when several gaming machines contribute to the same jackpot, the jackpot progressively increases at a much faster rate. Progressive jackpots will typically continue to grow, without restriction, based on coin-in contributions until the progressive-winning symbol combination is achieved. Because the bonus game and progressive game concepts offer tremendous advantages in player appeal and excitement relative to other known games, and because such games are attractive to both players and operators, there is a continuing need to develop gaming systems with new types of bonus games to satisfy the demands of players and operators.

SUMMARY

Aspects of the present disclosure are directed to electronic gaming devices, gaming systems and networks, methods of conducting wagering games, and game-logic circuitry with executable instructions for conducting wagering games with progressive jackpots. Disclosed, for example, are methods for configuring progressive wagering games to increment a progressive jackpot down to the pennies digit in different manners depending upon the type of the game (e.g., minimum wager, maximum wager, most common wager, range of wagers between minimum and maximum, etc.). Optionally, different gaming devices, e.g., with different games, that are linked to the same progressive jackpot may display the incrementing of the progressive jackpot in different manners. For some implementations, the method calculates metering speed dynamically. Many of the disclosed concepts can be implemented in stand-alone progressive (SAP) games, local area progressive (LAP) games, and/or wide area progressive (WAP) games. These concepts help to improve the operation of electronic gaming machines and casino gaming systems, including the wagering games conducted by such machines and systems, by increasing system control and functionality in conducting progressive jackpots. By way of example, many of the disclosed concepts allow for progressive gaming devices and systems that are operable to dynamically control, e.g., in real-time, the incrementing of a progressive jackpots, regardless of denomination, across a wide spectrum of product propositions. This will help to improve product performance and optimize product scalability and flexibility for cross-platform integration.

Aspects of the present disclosure are directed to electronic gaming machines (EGM) for conducting wagering games. For example, disclosed herein is an EGM for playing a regulated casino wagering game associated with a progressive jackpot. The EGM includes a gaming cabinet for housing electronic components operable for conducting the casino wagering game. An electronic display device is coupled to the gaming cabinet and configured to display outcomes of the casino wagering game. Moreover, an electronic input device, which is also coupled to the gaming cabinet, is configured to receive a physical input from a player to initiate the casino wagering game, and then transform the physical input into an electronic data signal. Game-logic circuitry is disposed within the gaming cabinet. This game-logic circuitry includes a random element generator that generates one or more random elements associated with play of the casino wagering game.

The EGM's game-logic circuitry is operable to: receive from the electronic input device an electronic data signal indicating receipt of a physical input from a player to initiate the casino wagering game; initiate the casino wagering game responsive to the electronic data signal generated by the electronic input device; randomly determine an outcome of the casino wagering game (e.g., from a plurality of available game outcomes) based, at least in part, on one or more random elements generated by the random element generator; direct the electronic display device to display the outcome; direct the electronic display device to display in a progressive jackpot meter a first jackpot value for the progressive jackpot; determine a meter speed for the progressive jackpot meter to incrementally display the first jackpot value being increased to a second jackpot value within a set amount of time; determine a controlled meter position from the meter speed; determine a first speed of scroll for the controlled meter position; determine a respective speed of scroll for each of the meter positions to the right of the controlled meter position, if any; direct the electronic display device to display the progressive jackpot meter incrementally increasing to the second jackpot value as restricted by the first speed of scroll and any respective speeds of scroll; and transmit an indication of an award in response to the outcome meeting a predetermined award criterion.

Other aspects of the present disclosure are directed to gaming systems for conducting a wagering games. For example, disclosed is a gaming system which includes a gaming machine having a gaming cabinet, an electronic display device, and an electronic input device. The gaming cabinet of the gaming machine is constructed to house components associated with the wagering game. The electronic display device and the electronic input device are operatively attached to the gaming cabinet. The electronic input device is configured to receive a physical input from a player to initiate the wagering game and transform the input into an electronic data signal. The gaming system also includes game-logic circuitry and an electronic random element generator, which is configured to generate one or more random elements associated with play of the wagering game.

The gaming system's game-logic circuitry is configured to: receive from the electronic input device the electronic data signal indicating receipt of the physical input from the player to initiate the wagering game; initiate the wagering game in response to the electronic data signal generated by the electronic input device; determine an outcome of the wagering game based, at least in part, on the one or more random elements generated by the random element generator; direct the electronic display device to display the outcome; direct the electronic display device to display in a progressive jackpot meter a first jackpot value of the progressive jackpot; determine a meter speed for the progressive jackpot meter to incrementally display the first jackpot value being increased to a second jackpot value within a set amount of time; determine a controlled meter position from the meter speed; determine a first speed of scroll for the controlled meter position; determine a respective speed of scroll for each of the meter positions to the right of the controlled meter position, if any; and, direct the electronic display device to display the progressive jackpot meter incrementally increasing to the second jackpot value as restricted by the first speed of scroll and any respective speeds of scroll.

Additional aspects of this disclosure are directed to computer-implemented methods, programmable game-logic circuitry, and game content engines for conducting progressive wagering games. In an example, disclosed herein is a method of operating a gaming system primarily dedicated to playing at least one regulated casino wagering game. The gaming system includes an electronic random element generator, game-logic circuitry, and an electronic gaming machine. The electronic gaming machine includes a gaming cabinet, an electronic display device, and an electronic input device. The gaming cabinet is constructed to house components associated with the casino wagering game. The method includes: receiving, from the electronic input device of the electronic gaming machine, an electronic data signal indicating receipt of a physical input from a player as an indication of a wager to initiate the casino wagering game, the casino wagering game being associated with a progressive jackpot; generating one or more random elements with the electronic random element generator; determining, via the game-logic circuitry, an outcome of the casino wagering game based, at least in part, on the one or more random elements; displaying the outcome of the casino wagering game via the electronic display device of the electronic gaming machine; displaying, via the electronic display device, a first jackpot value of the progressive jackpot in a progressive jackpot meter; determining, via the game-logic circuitry, a meter speed for the progressive jackpot meter to incrementally display the first jackpot value increase to a second jackpot value within a set amount of time; determining, via the game-logic circuitry, a controlled meter position from the meter speed; determining, via the game-logic circuitry, a first speed of scroll for the controlled meter position; determining, via the game-logic circuitry, a respective speed of scroll for each of the meter positions to the right of the controlled meter position, if any; displaying, via the electronic display device, the progressive jackpot meter incrementally increasing to the second jackpot value as restricted by the first speed of scroll and any respective speeds of scroll; and, transmitting, via the game-logic circuitry, an indication of an award to the player in response to the outcome meeting a predetermined award criterion.

The above summary does not represent every embodiment or every aspect of the present disclosure. Rather, the foregoing summary merely provides an exemplification of some of the novel aspects and features set forth herein. The above features and advantages, and other features and advantages of the present disclosure, which are considered inventions both singly and in any combination, will be readily apparent from the following detailed description of representative embodiments and modes for carrying out the present disclosure when taken in connection with the accompanying drawings and the appended claims.

Figure 1:
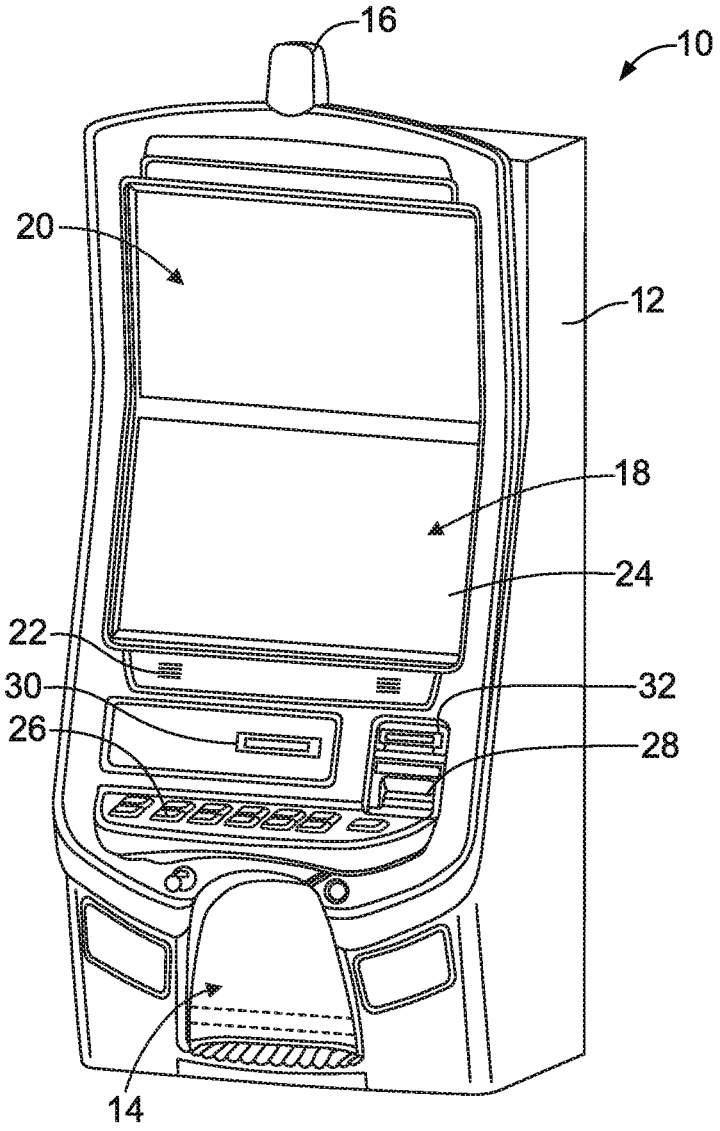
FIG. 1 is a perspective-view illustration of a representative free-standing electronic gaming machine (EGM) according to aspects of the present disclosure.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, this disclosure is to cover all modifications, equivalents, combinations, subcombinations and alternatives falling within the spirit and scope of the invention as defined by the appended claims.

DETAILED DESCRIPTION OF ILLUSTRATED EXAMPLES

This disclosure is susceptible of embodiment in many different forms. There are shown in the drawings, and will herein be described in detail, representative embodiments with the understanding that the present disclosure is to be considered as an exemplification of the principles of the present disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed or logically prohibited: the singular includes the plural and vice versa; and the words "including" or "comprising" or "having" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to the drawings, wherein like reference numerals refer to like features throughout the several views, there is shown in FIG. 1 an electronic gaming machine (EGM), designated generally at 10, similar to those operated in gaming establishments, such as casinos. With regard to the present disclosure, the gaming machine 10 may be any type of gaming terminal or machine ("gaming terminal" and "gaming machine" and "gaming device" being used interchangeably in this disclosure) and may have varying structures and methods of operation. For example, in some aspects, the gaming machine 10 is an electromechanical gaming terminal configured to play slots with mechanical reels, whereas in other aspects, the gaming machine is an electronic gaming terminal configured to play a video casino game, such as slots, keno, poker, blackjack, roulette, craps, etc. The gaming machine 10 may take any suitable form, such as floor-standing models (as shown), handheld mobile gaming units, bartop gaming models, workstation-type console models, etc. Further, the gaming machine 10 may be primarily dedicated for use in playing casino wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, all of which are incorporated herein by reference in their respective entireties and for all purposes.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
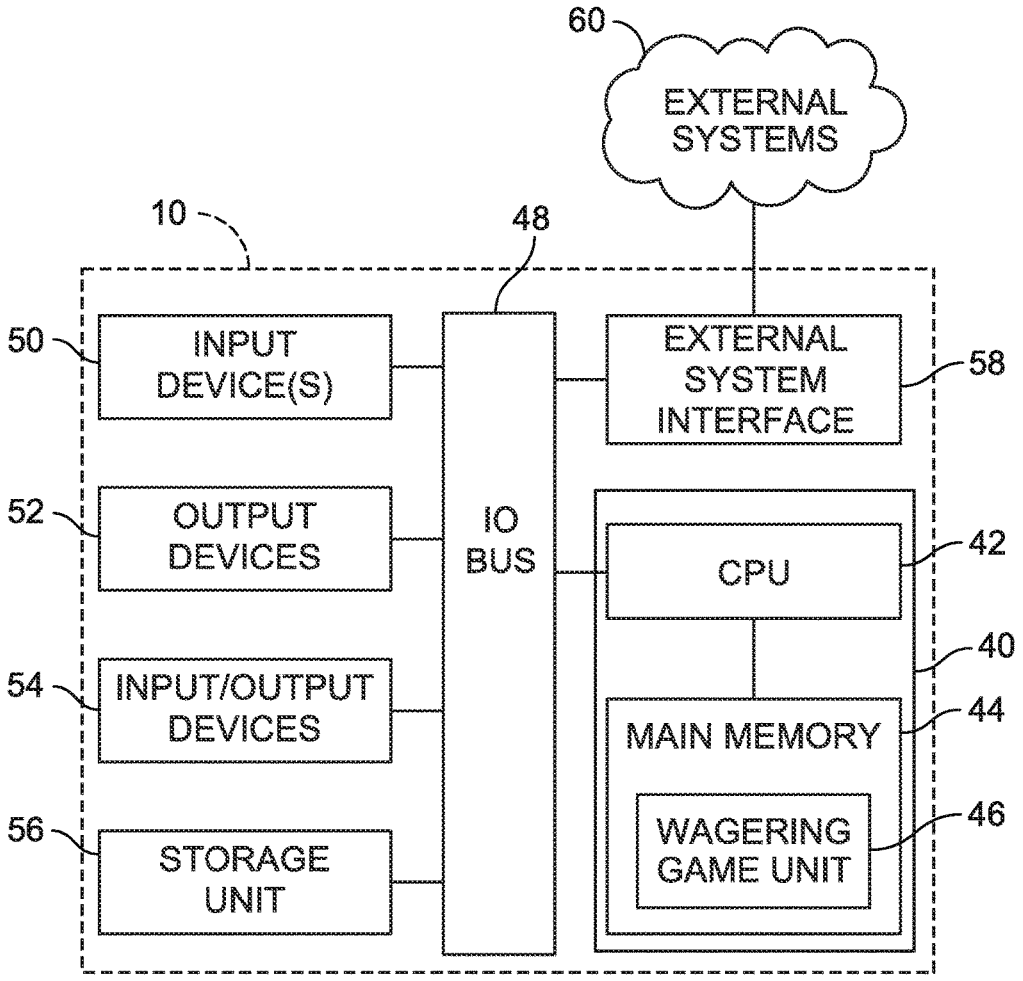
FIG. 2 is a schematic diagram of a representative electronic gaming machine (EGM) in a networked gaming system according to aspects of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both, are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
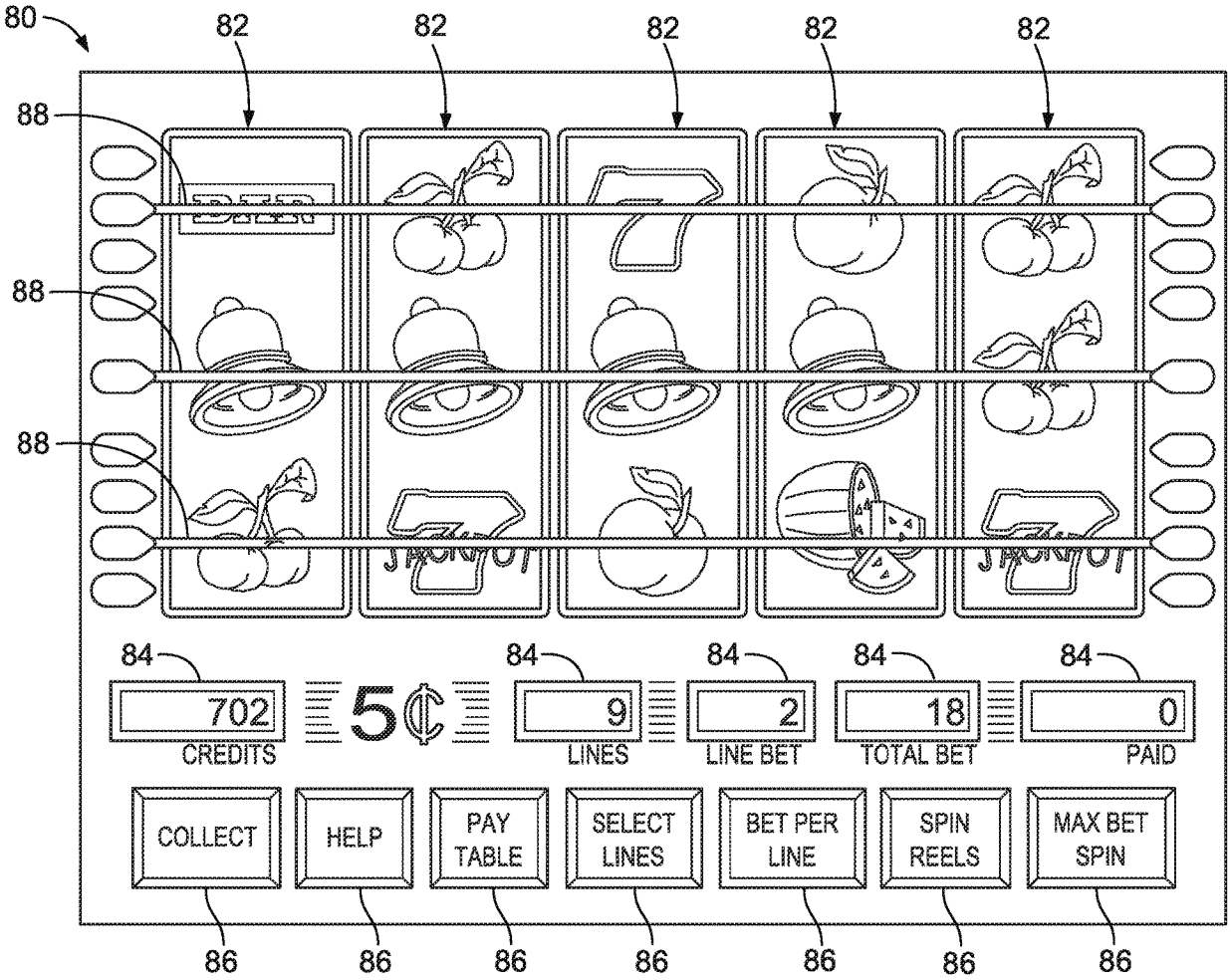
FIG. 3 is a screen shot of a representative basic-game screen of a casino game displayed on a dedicated casino gaming device according to aspects of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
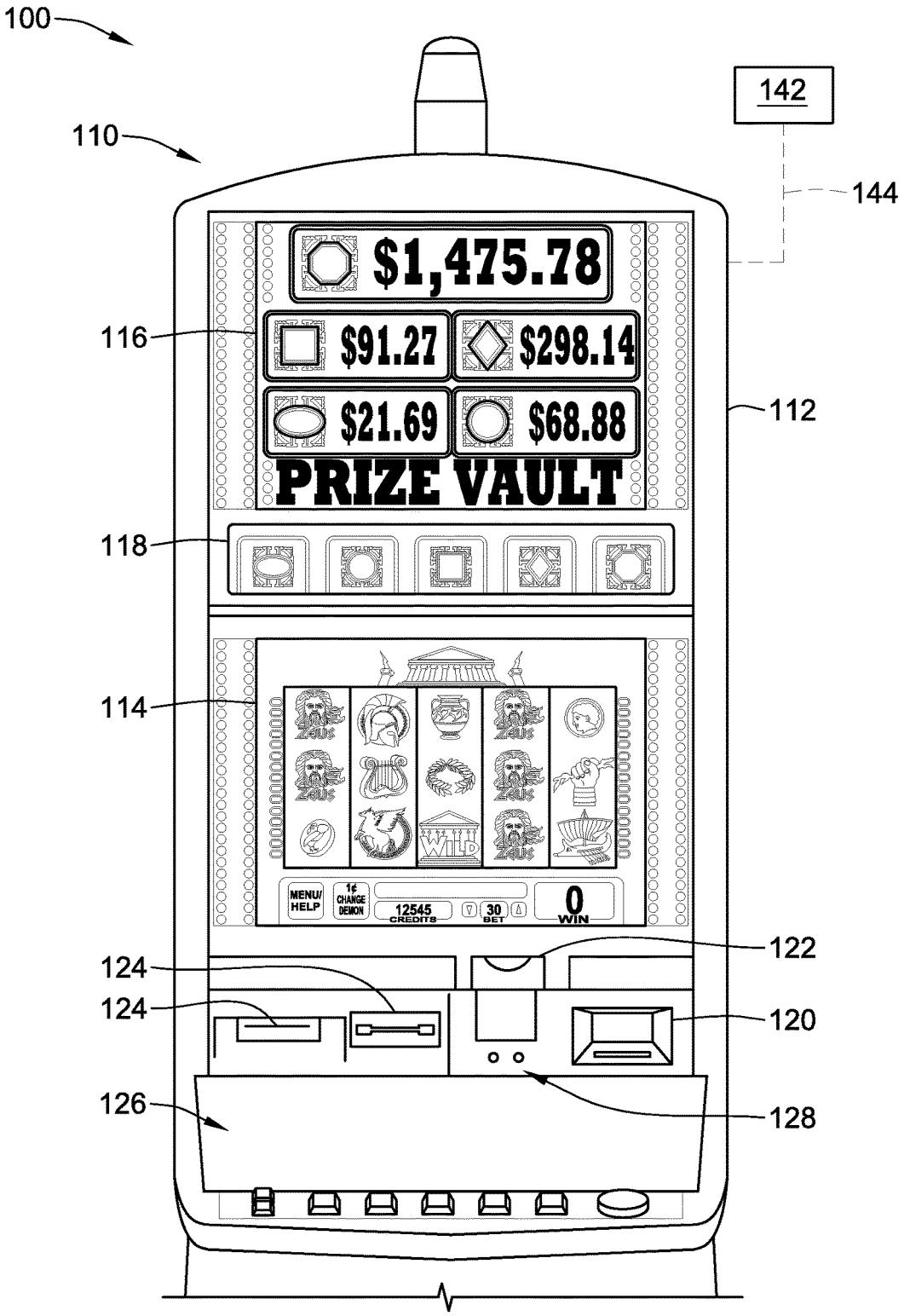
FIG. 4 is a front-view illustration of a representative gaming terminal for playing an exemplary progressive wagering game in accordance with aspects of the present disclosure.

Referring now to FIG. 4, a representative electronic gaming machine (EGM), designated generally at 110, for playing one or more wagering games is shown in accordance with aspects of the present disclosure. Although differing in appearance, the EGM 510 can be similar in function, operation, and connectivity to the gaming terminal 10 discussed above with respect to FIG. 1 and the gaming system discussed above with respect to FIG. 2 and, thus, can include any of the options, features and alternatives described with respect thereto. The electronic gaming machine 110 (also referred to herein as "casino gaming machine" or "gaming terminal") can take on various configurations including, for example, free standing gaming machines (as shown), handheld or portable gaming machines, countertop gaming machines, and the like. To that end, the electronic gaming machine 110 may be an electromechanical gaming terminal configured, for example, to play mechanical slots, or it may be an electronic gaming terminal configured, for example, to play a video casino game, such as keno, poker, slots, blackjack, roulette, etc. Markedly, the electronic gaming machine 110 of FIG. 4 is purely representative in nature, and presented solely for explanatory purposes. As such, all aspects of the present invention are in no way limited to the terminal configuration shown in the drawings.

Gaming machine 110 comprises a secured gaming cabinet 112 for housing a variety of operational componentry (e.g., game-logic circuitry 40, external systems interface 58, etc.). For output devices, the electronic gaming machine 110 includes a primary display area (or "first display device") 114, a secondary display area (or "second display device") 116, and a tertiary display area (or "third display device") 118. Recognizably, one or more or all of the foregoing display areas/devices can be combined into a single display area/device. For input devices, the electronic gaming machine 110 may include a bill-receiving and validating device 120, a coin acceptor 122, one or more information readers 124, one or more play-control input devices 126, and one or more player-accessible ports 128 (e.g., an audio output jack for headphones, a video headset jack, an internet cable jack, a wireless transmitter/receiver, etc.). While these typical components found in the electronic gaming machine 110 are described above, it should be understood that numerous additional/alternative peripheral devices and other elements may exist and may be used in any number of combinations to create various forms of a gaming terminal.

Similar to embodiments presented above in FIGS. 1 and 2, the EGM 110 of FIG. 4 may communicate with an external system (e.g., external system(s) 60 of FIG. 2) such that the terminal operates as a "thin client," a "thick client," or through any range of functionality therebetween. By way of example, a casino gaming system (CGS) controller is schematically illustrated at 142 in FIG. 4 operatively connected to the electronic gaming machine 110 such that the gaming machine 110 can access and engage in external game-related and non-game related features, such as a shared game, a community game, a local area progressive (LAP) game, a wide area progressive (WAP) game, etc. The CGS controller 142 may be similarly configured in accordance with any of the optional configurations and features described above with respect to the CPU 42 of FIG. 2. For some optional embodiments, the CGS controller 142 takes on the form of a central server or server system, a central controller, a dedicated progressive jackpot controller, and/or a remote host that links to the electronic gaming machine 110 through a data network or remote communication link 144. To that end, the game-logic circuitry of the electronic gaming machine 110 can be designed to transmit and receive events, messages, commands, and/or any other suitable data or signals to and from the controller 142. In combination, the electronic gaming machine 110 and CGS controller 142 can be considered a gaming system 100 or part of a gaming system 100.

Figure 5:
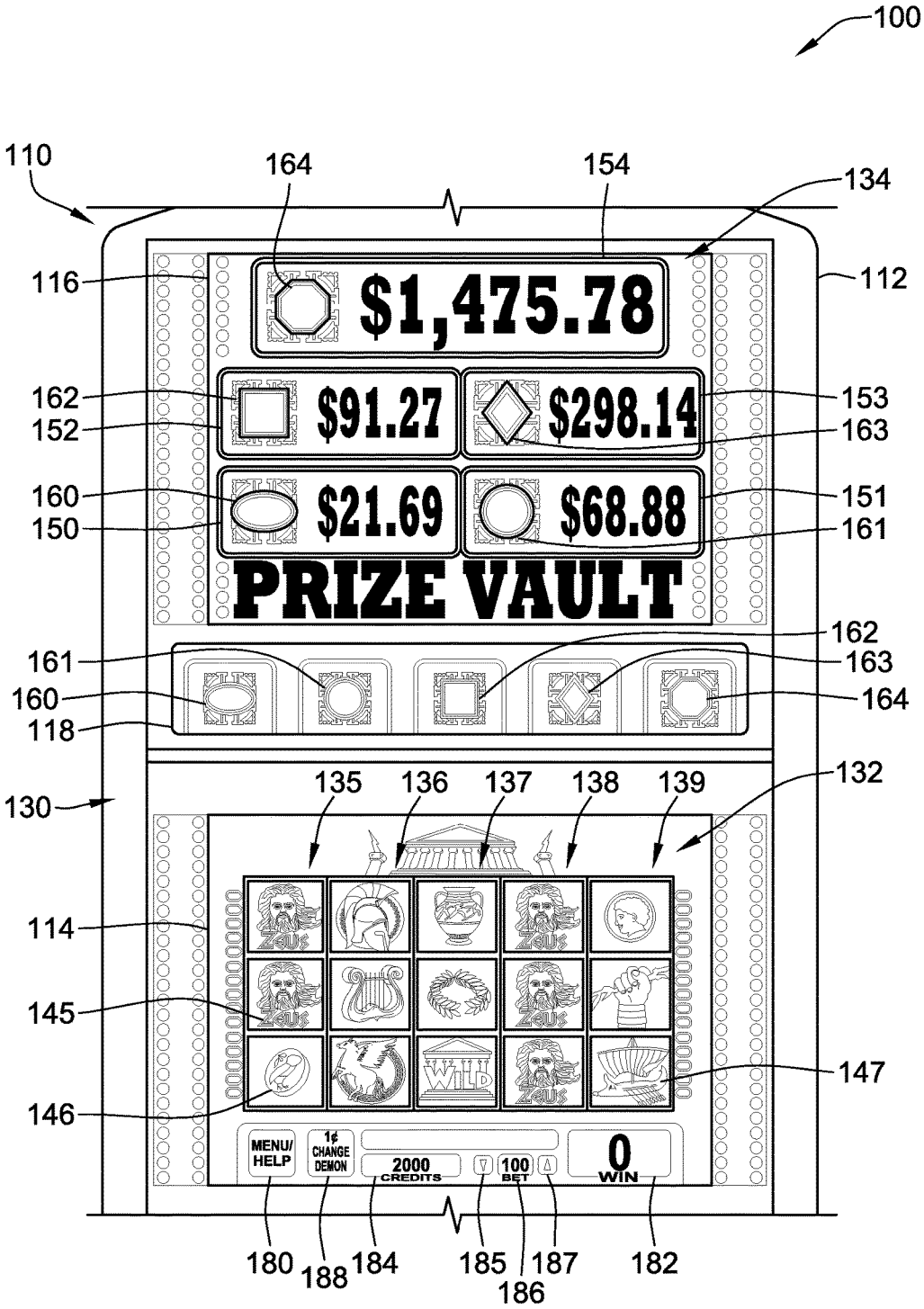
FIG. 5 is a front-view illustration of primary and secondary electronic display devices displaying screen shots of a basic-game screen and a progressive-game screen, respectively, from the representative progressive wagering game of FIG. 4.

In FIG. 5, the three display areas 114, 116, 118 of the EGM 110 are shown displaying different aspects of a wagering game 130. First electronic display device 114, for instance, displays or otherwise visually depicts a base game 132 portion of the wagering game 130, which in this example is the video slot game shown in FIG. 5. Base game 132 comprises a plurality of symbol-bearing reels, represented herein by five simulated reels 135-139, each with a sequence of distinct symbol positions occupied by a variety of different symbols (collectively represented by symbols 145-147 in FIG. 5). The symbols may include any variety of graphical symbols, emblems, elements, or representations, including symbols that are associated with one or more themes (e.g., a Greek mythology theme) of the gaming machine 110 or the gaming system 100. The reel symbols may also include a blank symbol or empty space. Select symbols on each of the reels 135-139 are arranged in an array or matrix, which in this embodiment is a 3×5 matrix of symbols. The reels 135-139 are varied (e.g., spun and stopped) to reveal combinations of symbols, which represent randomly selected outcomes of the wagering game 130, that are evaluated for winning combinations. Winning combinations of symbols landing, for example, on activated paylines (e.g., those paylines for which a wager has been received), cause awards to be paid in accordance with one or more pay tables associated with the gaming machine 110.

The casino wagering game 130 can include greater or fewer symbol-bearing reels (simulated, mechanical, or otherwise), each of which may include greater or fewer symbols than that shown in FIGS. 4 and 5. In the same vein, the randomly selected outcomes of the base game 132 may comprise greater or fewer than 15 symbols, and may take on a variety of different forms having greater or fewer rows and/or columns. The matrix may even comprise other non-rectangular forms or arrangements of symbols. Moreover, the randomly selected outcomes of the wagering game 130 may be varied from the representation provided in FIGS. 4 and 5. Likewise, the Greek mythology theme is purely illustrative and non-limiting in nature.

Primary display 114 presents certain display features for providing information and options to a player. For example, the display 114 features may include a MENU/HELP button 180, a WIN meter 182, a CREDITS meter 184, and a BET meter 186. The MENU button 180 can be pressed and activated (e.g., through an overlying touch screen) by a player desiring to access other control menus, preferences, help screens, etc. For example, the player can change a theme of the wagering game 130 via the MENU button 180, or change the type of wagering game being played (e.g., to video poker, keno, etc.). The WIN meter 182 displays to the player the amount of the total win (if any) from the most recent play of the wagering game 130. The CREDITS meter 184 displays to the player the total amount of credits (if any) remaining and available to the player for play of the wagering game 130. The BET meter 186 displays to a player the current size of his/her wager (in credits). Fewer, additional or alternative display features may be included for presenting information/options to a player. The primary display 114 can also include, for example, an optional CHANGE DENOM button 188 that can be activated to change the denomination of wagers (e.g., from $0.25 minimum wager to $1.00 minimum wager) which the player is inputting into the system 100. Bet change buttons 185 and 187 permit a player to incrementally increase and decrease, respectively, the size of his/her wager. Optionally, a "max bet spin" button (not shown) may be provided for wagering a maximum number of credits and contemporaneously spinning the reels of the wagering game 130, as well as any of the buttons and meters displayed in FIG. 3.

With continuing reference to FIG. 5, second electronic display device 116 displays a multi jackpot progressive game 134 portion of the wagering game 130. The multi jackpot progressive game 134 of FIG. 5 can be a wide area progressive (WAP), a local area progressive (LAP), a stand alone progressive (SAP), a portal application, or selected combinations thereof. Progressive game 134 may comprise one progressive jackpot or, as shown, multiple progressive jackpots (also referred to herein as "progressive levels") 150-154, each of which may be associated with a respective icon or marker 160-164, respectively. By way of non-limiting example, a first progressive jackpot 150 with a first progressive jackpot value (e.g., $21.69 in FIG. 5) is associated with a first icon 160 (e.g., an oval-cut jewel). A second progressive jackpot 151 with a second progressive jackpot value (e.g., $68.88 in FIG. 6) is associated with a second icon 161 (e.g., a circular-cut jewel in FIG. 5), whereas a third progressive jackpot 152 with a third progressive jackpot value (e.g., $91.27 in FIG. 5) is associated with a third icon 162 (e.g., a square-cut jewel in FIG. 5). In addition, a fourth progressive jackpot 153 with a fourth progressive jackpot value (e.g., $298.14 in FIG. 5) is associated with a fourth icon 163 (e.g., a diamond-cut jewel in FIG. 5), while a fifth progressive jackpot 154 with a fifth progressive jackpot value (e.g., $1,475.78 in FIG. 5) is associated with a fifth icon 164 (e.g., a pentagonal jewel in FIG. 5). Recognizably, progressive wagering game 134 can include greater or fewer than five progressive jackpots, each having a respective value that differs from that which is shown in the drawings. Moreover, the progressive values illustrated in FIG. 5 are purely exemplary in nature, and are in no way limiting.

In the illustrated example, the linking or association between the individual progressive jackpots 150-154 and a respective icon/marker 160-164 is intended merely as a way to visually convey to a player via the second and/or third electronic display devices 116, 118 when a particular jackpot is active (i.e., when the player is eligible to win a progressive jackpot 150-154 during play of the base game 132). Third electronic display device 118 indicates that a progressive jackpot 150-154 is active or eligible by enlarging, flashing, setting off, or otherwise emphasizing the corresponding icon 160-164 associated with each active jackpot. Recognizably, the eligibility of one or more of the progressive jackpots 150-154 can be achieved by implementations other than the manner illustrated in the drawings and discussed above. For example, eligibility for a particular progressive jackpot can be indicated by enlarging, flashing, setting off, or otherwise emphasizing the value associated with each active jackpot. As an additional or alternative option, an audible indication can be provided.

In the embodiment shown, each of the progressive jackpots 150-154 comprises an award that increments, for example, in response to a player at EGM 110 placing wagers on and playing wagering game 130. Optionally, one or more of the progressive jackpots 150-154 can be incrementally increased in response to players on participating EGM's (e.g., those connected to the jackpots through gaming system 100 via data network 144) placing wagers on and playing other competing wagering games. A percentage or portion of each wager received into the EGM 110 and/or gaming system 100 contributes to one or more progressive jackpot increment amounts, each of which causes one or more of the progressive jackpots to increase in value, as displayed on the second electronic display device 116. In an embodiment, each progressive jackpot 150-154 continues to receive increment amounts, thereby increasing in value, until a triggering event occurs and one or more jackpot 150-154 is awarded to a player. When awarded, a progressive jackpot 150-154 can be reset to a corresponding predefined reset value. Other conventional methods of funding the progressive jackpots are also envisioned as being within the scope and spirit of the present disclosure.

Figure 6A:
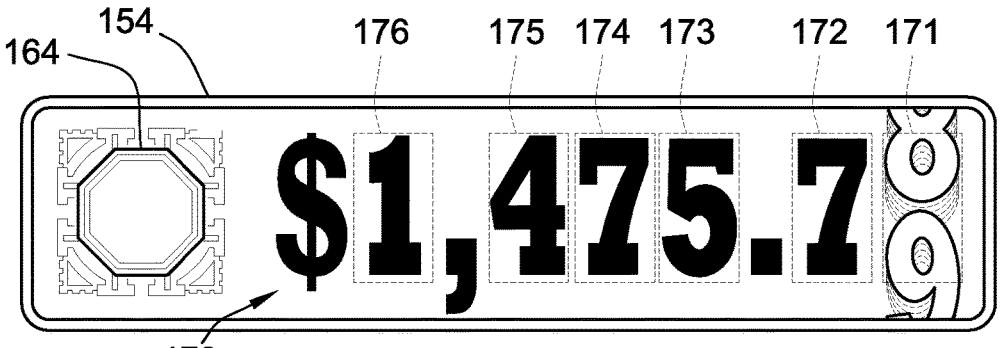
FIGS. 6A-6C are illustrations of a representative progressive jackpot meter progressively incrementing from a first (current) jackpot value to a second (increased) jackpot value in accordance with aspects of the present disclosure.
Figure 6B:
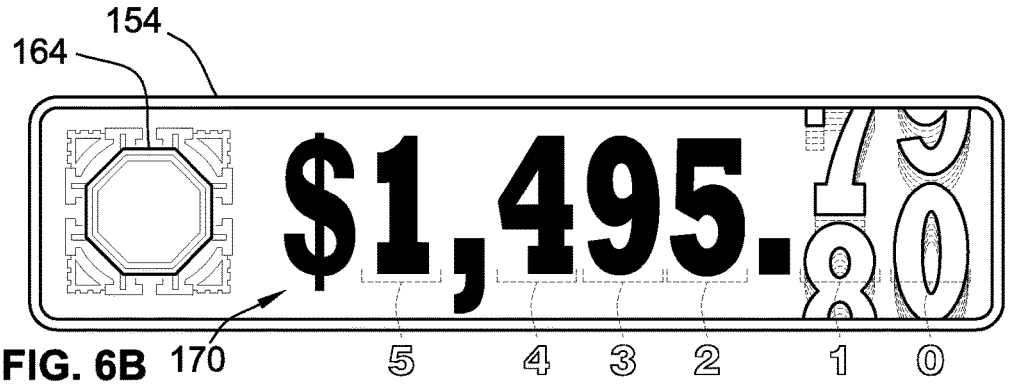
Figure 6C:
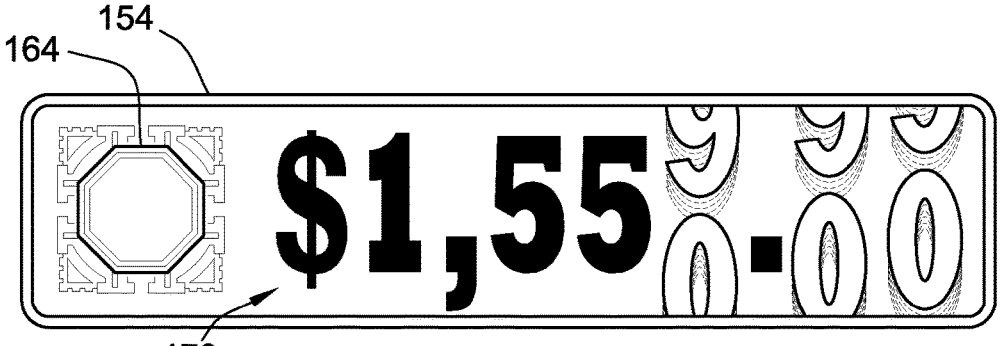

FIGS. 6A-6C illustrate one of the representative progressive jackpot meters 170 from the multi jackpot progressive game 134 of FIGS. 4 and 5. Progressive jackpot meter 170 is shown in FIGS. 6A-6C displaying to a player the progressive incrementing of a representative progressive jackpot 154 from a current (first) jackpot value, an example of which is shown in FIG. 6A, through an intermittent progressive jackpot value, as shown in FIG. 6B, to an increased (second) jackpot value, an example of which is shown in FIG. 6C. With reference to FIG. 6A, the progressive jackpot meter 170 includes a row of juxtaposed meter positions—e.g., six side-by-side meter positions 171-176—each of which displays integers corresponding to a respective base-ten value of a monetary unit. By way of example, the first meter position 171 comprises ten (10) single-digit whole numbers, arranged sequentially from zero (0) through nine (9), to represent the hundredths place or pennies value of a U.S. dollar. Second meter position 172, by comparison, comprises ten (10) single-digit whole numbers, arranged sequentially from zero (0) through nine (9), to represent the tenths place or dimes value of a U.S. dollar. Likewise, the third, fourth, fifth and sixth meter positions 173-176 each comprises ten whole numbers, arranged sequentially from zero through nine on a respective dial. Third meter position 173 represents the ones place or whole U.S. dollar value, while the fourth meter position 174 represents the tens place or ten U.S. dollars value, and so on through the thousands place or thousand U.S. dollars value shown in the sixth meter position 176.

The progressive jackpot meters discussed and claimed herein are not limited to the examples provided in the drawings. One optional aspect is to increase or decrease the number of meter positions provided by each meter. A non-limiting example comprises progressive jackpot meters with meter positions that display only whole values for a monetary unit (e.g., whole U.S. dollars) without any fractions of the monetary unit (e.g., pennies and dimes are not displayed). Another example comprises progressive jackpot meters that display additional base-ten values for a monetary unit (e.g., a ten-thousands place, a hundred-thousands place, and/or a millions place) or fewer base-ten values for a monetary unit (see, e.g., meters for the third and fourth progressive jackpots 152 and 153 in FIG. 5). Moreover, the number of meter positions need not per se be fixed but may vary as the jackpot value changes (e.g., fewer meter positions are displayed when the jackpot is decreased to a reset value). It should also be readily apparent that the disclosed concepts are not restricted to the exemplary monetary unit, but can be employed for other forms of currency and other representations of value. While the illustrated example portrays the meter 170 as comprising a row of video-simulated dials, the inventive aspects disclosed herein can also be applied to electro-mechanical dials and other meter permutations.

Each of the meter positions 171-176 of the progressive jackpot meter 170 in FIGS. 6A-6B is assigned a respective meter position number. For purposes of description, the meter positions are numbered sequentially, starting at zero, from right-to-left. According to the example illustrated in FIG. 6B, first meter position 171, which is the smallest displayed denomination located farthest to the right in the jackpot meter 170, is assigned meter position number zero (0). The second meter position 172, located directly to the left of the first meter position 171, is assigned meter position number one (1), whereas the third meter position 173 is assigned meter position number two (2). In this regard, fourth meter position 174 is assigned meter position number three (3), while the fifth meter position 175, located directly to the right of the left-most sixth meter position 176, is assigned meter position number four (4). Sixth meter position 176, which is the largest displayed denomination, is assigned meter position number five (5). It is desirable, for some preferred embodiments, that the meter position numbers not be displayed to the player. Furthermore, the numbering sequence presented in the figures is provided purely for purposes of clarity and explanation, and is therefore non-limiting in nature.

Figure 7:
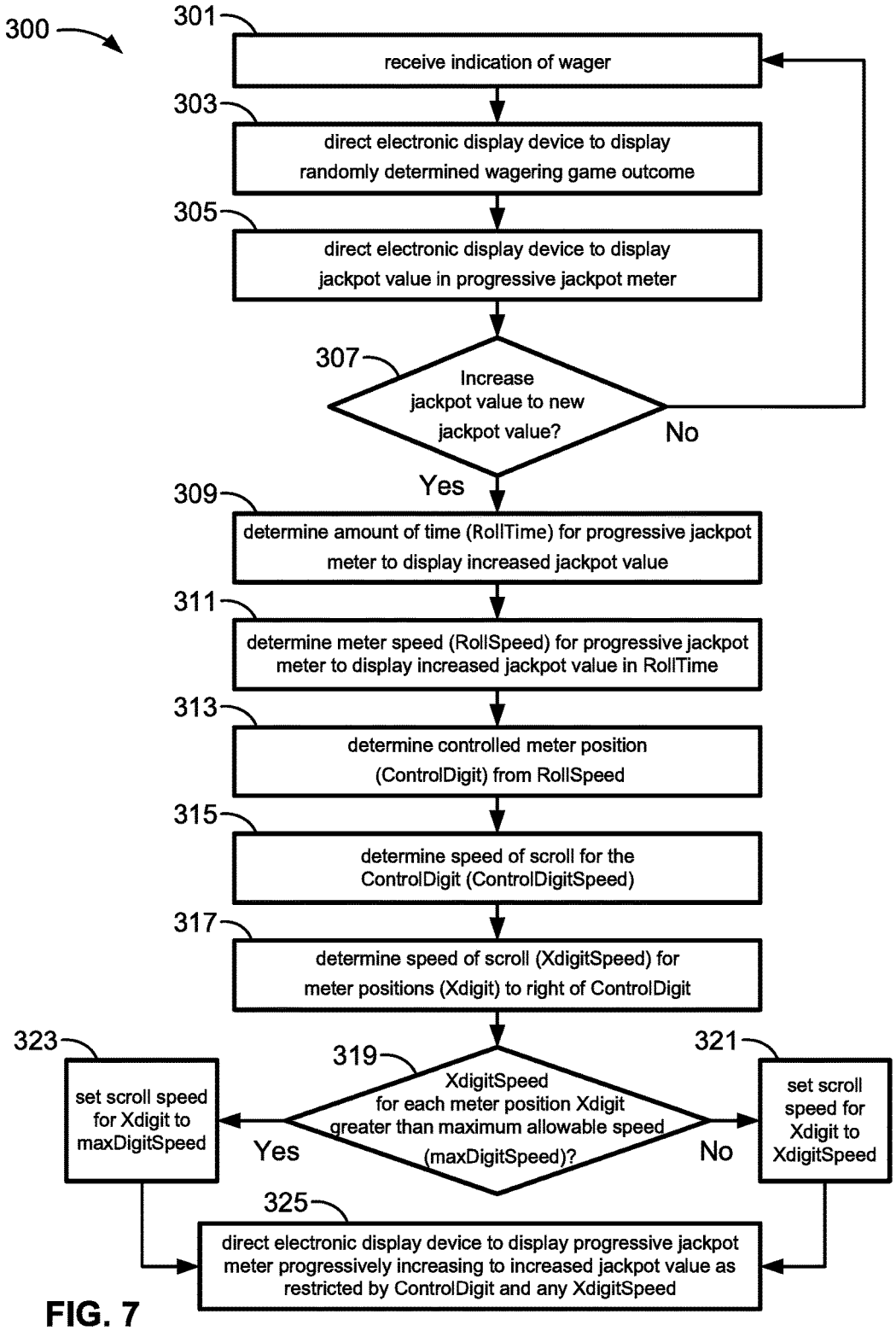
FIG. 7 is a flowchart for an algorithm that corresponds to instructions executed by game-logic circuitry of a gaming system or an electronic gaming machine in accord with aspects of the disclosed concepts.

With reference now to the flow chart of FIG. 7, an improved method for conducting a wagering game on a gaming terminal and/or a gaming system, such as those shown in FIGS. 1-6, for example, is generally described at 300 in accordance with aspects of the present disclosure. FIG. 7 can be representative of an algorithm that corresponds to instructions that can be executed, for example, by the game-logic circuitry 40 (FIG. 2) and/or external system(s) 60 (FIG. 2) to perform any or all of the above or below described functions associated with the disclosed concepts. The method 300 will be described with reference to the various aspects and features shown in FIGS. 1-6 of the drawings; such reference is being provided purely by way of explanation and clarification.

The method 300 begins at Block 301 with receipt of an indication of a wager to initiate a wagering game, such as progressive wagering game 130 of FIGS. 4 and 5. This step may comprise receiving from an electronic input device, such as touch screen 24, button panel 26, bill/ticket acceptor 28, or card reader/writer 30, one or more electronic data signals indicating receipt of one or more physical inputs from a player to place a wager and contemporaneously commence the base game 132 portion of casino wagering game 130. Responsive to the electronic data signal(s) generated by the electronic input device(s), the gaming device/system will initiate the wagering game and, optionally, determine an outcome of the game based, at least in part, on one or more random elements generated by one or more electronic random element generators (e.g., random number generator (RNG) and game-outcome logic).

At Block 303, the method 300 will then direct one or more electronic display devices to display the randomly determined wagering game outcome. Block 303 may comprise symbol-bearing reels (e.g., reels 135-139) being spun and stopped to reveal a select combination of symbols arranged in a symbol array. This step may optionally include transmitting an indication of an award to a player in response to the randomly determined outcome meeting a predetermined award criterion (e.g., the displayed outcome including at least one predetermined winning combination of symbols landing, for example, on an activated payline).

Prior to, contemporaneous with, or after displaying the randomly determined game outcome at Block 303, the method 300 proceeds to Block 305 in FIG. 7 and directs one or more electronic display devices to display a first jackpot value in a progressive jackpot meter. As an example, progressive jackpot meter 170 of FIG. 6A displays a current jackpot value of $1,475.78 for the progressive jackpot 154. Other examples of jackpot meters displaying jackpot values can be seen in FIGS. 4 and 5 for progressive jackpots 150-153.

The method 300 continues to Decision 307 where it is determined if the displayed (current) jackpot value has grown to a new (increased) jackpot value. This step should be considered optional as the increase of a particular jackpot can be automatic or can be controlled by an offboard progressive control engine, central server, or host system, and therefore does not require a dedicated step of determining whether such an increase has occurred. For instance, Decision 307 may merely require receiving an indication that the displayed jackpot value for a progressive jackpot meter has increased and the meter must be updated to reflect the added amount. Game-logic circuitry 42 of an EGM 10, for example, can be operable to receive a jackpot-increase signal from External Systems 60, said signal indicating that the jackpot value has increased or otherwise changed to a new jackpot value. As a non-limiting example, the jackpot-increase signal may indicate that the progressive jackpot 154 has been increased by a progressive jackpot increment amount of $75.00.

If it is determined that the displayed jackpot value has grown to a new (increased) jackpot value (307=YES), method 300 of FIG. 7 then continues to Block 309 with determining a set amount of time (RollTime) during which the progressive jackpot meter is to display the jackpot value incrementally increasing from the first (current) jackpot value to the second (increased) jackpot value. Similar to Decision 307, Block 309 can be considered optional for method 300 as the RollTime can be preset (e.g., RollTime is set to a default time that is fixed prior to initiating the wagering game) or can be determined by a remote central server, host controller, progressive game engine, etc. Alternatively, the game-logic circuitry can be further configured to determine a set amount of time within which the progressive jackpot meter must incrementally display the first jackpot value increase to the second jackpot value. The set amount of time, for some optional embodiments, is determined in real-time with each increase of the progressive jackpot meter. In some implementations, the RollTime is not merely a time limit—a limited range of time at any point during which the progressive jackpot meter must display the new jackpot value; rather, the RollTime can be a specified duration of time or continuous time period during which the progressive jackpot meter displays the jackpot value incrementally increasing to the new jackpot value. As a non-limiting example, the progressive jackpot meter must display the current jackpot value incrementally grow by $75.00 over a 10 second duration of time (RollTime=10 sec) to an increased jackpot value.

Once the RollTime is known, the method will calculate or otherwise determine at Block 311 a meter speed (Roll Speed) to ensure the progressive jackpot meter will incrementally display the first jackpot value being increased to the second jackpot value during the RollTime. By way of non-limiting example, the meter speed (RollSpeed) is equal to a delta money value (deltaMoney), comprising the difference between the second jackpot value and the first jackpot value, divided by the set amount of time (RollTime):

$$\text{RollSpeed}=\text{deltaMoney}/\text{RollTime}$$

In some implementations, the delta money value is an integer with units corresponding to the lowest denomination displayed in the progressive jackpot meter. Continuing with the above example, the lowest denomination displayed in the progressive jackpot meter 170 is the hundredths place or pennies value of a U.S. dollar presented by the first meter position 171. Accordingly, with a progressive jackpot increment amount of $75.00, the deltaMoney is equal to 7500 cents (¢). With this deltaMoney value and the previously determined RollTime of 10 seconds, the RollSpeed for this example is 750 cents/sec. However, if our representative progressive jackpot meter was only displaying whole-dollar units (i.e., pennies and dimes are not displayed), the RollSpeed would be calculated as 7.5 dollars/second.

With continuing reference to FIG. 7, Block 313 includes determining a controlled meter position (ControlDigit) from the meter speed (RollSpeed) identified at Block 311. As indicated above in the discussion of FIG. 6B, each of the meter positions 171-176 of the progressive jackpot meter 170 in FIGS. 6A-6B is assigned a respective meter position number: the first meter position 171 is assigned meter position number 0; the second meter position 172 is assigned position number 1; the third meter position 173 is assigned position number 2; fourth meter position 174 is assigned position number 3; fifth meter position 175 is assigned position number 4; and sixth meter position 176 is assigned position number 5. For at least some implementations of the disclosed concepts, the controlled meter position (ControlDigit) is determined to be the meter position assigned meter position number N, where:

$$N=(\text{number of digit places in meter speed}-1).$$

In accord with our above example, the RollSpeed is equal to 750 cents/second; there are three digit places in this representative meter speed. Consequently, N is equal to 3-1, and the ControlDigit is the meter position assigned meter position number 2, which is the third meter position 173 in the illustrated example (ControlDigit=2).

At Block 315, method 300 continues to next determine a (first) speed of scroll (ControlDigitSpeed) for the controlled meter position (ControlDigit) that was identified in Block 313. For at least some implementations of the disclosed concepts, the speed of scroll (ControlDigitSpeed) for the controlled meter position (ControlDigit) is equal to the meter speed (RollSpeed) divided by ten to the power of the meter position number of the controlled meter position (ControlDigit):

$$ControlDigitSpeed = \frac{RollSpeed}{(10\hat{}ControlDigit)}.$$

Continuing with our above-discussed example, the (first) speed of scroll (ControlDigitSpeed) for the controlled meter position (ControlDigit) is equal to 750/(10^2) or 7.5 increments or "clicks" per second (e.g., 7.5 dollars/second).

Prior to, contemporaneous with, or after determining the (first) speed of scroll for the controlled meter position, Block 317 requires preliminarily determining a respective speed of scroll (XdigitSpeed) for each of the meter positions (Xdigit) to the right of the controlled meter position (ControlDigit). In the above example, there are two meter positions to the right of the controlled meter position—the first and second meter position 171 and 172 assigned meter position number 0 and 1, respectively. In this instance, method 300 would calculate a 0digitSpeed for the first meter position 171 (0digit) and a 1digitSpeed for the second meter position 172 (1digit). For at least some implementations of the disclosed concepts, the respective speed of scroll (XdigitSpeed) for an adjacent meter positions (Xdigit) is preliminarily determined to be equal to the meter speed (RollSpeed) divided by ten to the power of the meter position number of the adjacent meter position (Xdigit):

$$XdigitSpeed = \frac{\text{meter speed}}{(10\hat{}\ \ Xdigit)}.$$

Continuing with our example, the respective speed of scroll (1digitSpeed) of the first meter position 171 (1digit) is equal to 750/(10^1) or 75 increments or "clicks" per second (e.g., 75 dimes/second). The respective speed of scroll (0digitSpeed) of the first meter position 171 (0digit), in contrast, is equal to 750/(10^0) or 750 increments or "clicks" per second (e.g., 750 cents/second). The XdigitSpeed can also be determined as follows:

$$XdigitSpeed = ControlDigitSpeed * 10\hat{}(ControlDigit - Xdigit)$$

Using either of these formulae, the dial for each meter position will spin at ten times the speed of the meter position to the left of it.

At Decision 319, method 300 will determine if each of the preliminary speed values (XdigitSpeed) for each of the adjacent meter positions (Xdigit) to the right of the controlled meter position (ControlDigit) is greater than a maximum allowable speed (maxDigitSpeed). In other words, is XdigitSpeed for Xdigit greater than maxDigitSpeed. This maximum allowable speed may be predefined, for example, by a game designer or an operator, may be randomly determined (e.g., by a random number generator (RNG) in game-logic circuitry), or may be a hardware or processor constraint resulting from the available electronics of an EGM. If the preliminary speed value (XdigitSpeed) for an adjacent meter position (Xdigit) is not greater than the maximum allowable speed (maxDigitSpeed Block) (319=NO), the method will continue to Block 321 where the scroll speed for said Xdigit is set to XdigitSpeed. Conversely, if the preliminary speed value (XdigitSpeed) for an adjacent meter position (Xdigit) is in fact greater than the maximum allowable speed (maxDigitSpeed Block) (319=YES), the method will continue to Block 323 where the scroll speed for said Xdigit is set to the maxDigitSpeed as modified by an offset value. For some implementations, in response to the speed (XdigitSpeed) of one of the meter positions (Xdigit) to the right of the controlled meter position (ControlDigit) being greater than the maximum allowable speed (maxDigitSpeed), the speed for said meter position is set equal to the maximum allowable speed minus a predetermined offset value:

$$XdigitSpeed = maxDigitSpeed - (2 * Xdigit).$$

By using the smaller of the outcomes of these formulae, the method 300 helps to ensure that the speed of an adjacent meter position never goes above the maxDigitSpeed.

Once the ControlDigitSpeed and XdigitSpeed(s) are determined, the method 300 proceeds to Block 325 and directs one or more electronic display devices to display the progressive jackpot meter progressively increasing the presently displayed jackpot value the to increased jackpot value as restricted by the first speed of scroll (ControlDigitSpeed) and any respective speeds of scroll (XdigitSpeed). For meter positions to the left of the controlled meter position (ControlDigit)—e.g., the fourth, fifth and sixth meter positions 174-176—the corresponding dial for each position remains stationary until the dial to the right of said position is showing a nine (9) that beings scrolling to a zero (0). At the onset of this transition, the two meter positions will scroll at least partially in unison. The progressive jackpot meter will maintain these determined speeds and continue scrolling until the second (increased) jackpot value has been reached, at which point the progressive jackpot meter will stop. Or, if a new progressive jackpot increment is received prior to reaching the increased jackpot value, the logic resumes or repeats from Block 307.

In some embodiments, the method includes at least those steps enumerated above. It is also within the scope and spirit of the present invention to omit steps, include additional steps, and/or modify the order presented above. It should be further noted that the foregoing method can be representative of a single sequence for conducting a wagering game. However, it is expected that the method will be practiced in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

The present invention is not limited to the precise construction and compositions disclosed herein; any and all modifications, changes, and variations apparent from the foregoing descriptions are within the spirit and scope of the invention as defined in the appended claims. Moreover, the present concepts expressly include any and all combinations and subcombinations of the preceding elements and aspects.

What is claimed:

1. An electronic gaming machine for conducting a casino wagering game, the casino wagering game being associated with a progressive jackpot, the electronic gaming machine comprising:

a gaming cabinet;

an electronic display device coupled to the gaming cabinet and configured to display outcomes of the casino wagering game;

an electronic input device coupled to the gaming cabinet and configured to receive a physical input from a player and transform the physical input into an electronic data signal; and game-logic circuitry disposed within the gaming cabinet, the game-logic circuitry including a random element generator configured to generate one or more random elements associated with play of the casino wagering game, the game-logic circuitry being configured to:

receive from the electronic input device the electronic data signal indicating receipt of the physical input from the player;

initiate the casino wagering game in response to the electronic data signal received from the electronic input device;

determine an outcome of the casino wagering game based, at least in part, on the one or more random elements generated by the random element generator;

direct the electronic display device to display the outcome;

direct the electronic display device to display in a progressive jackpot meter a first jackpot value for the progressive jackpot;

determine a meter speed for the progressive jackpot meter to incrementally display the first jackpot value being increased to a second jackpot value within a set amount of time;

determine a controlled meter position from the meter speed;

determine a first speed of scroll for the controlled meter position;

determine a respective speed of scroll for each of the meter positions to the right of the controlled meter position, if any;

direct the electronic display device to display the progressive jackpot meter incrementally increasing to the second jackpot value as restricted by the first speed of scroll and any respective speeds of scroll; and transmit an indication of an award in response to the outcome meeting a predetermined award criterion.

2. The gaming machine of claim 1, wherein the game-logic circuitry is further configured to determine the set amount of time during which the progressive jackpot meter must incrementally display the first jackpot value increase to the second jackpot value.

3. The gaming machine of claim 2, wherein the set amount of time is determined in real-time with each increase of the progressive jackpot meter.

4. The gaming machine of claim 1, wherein the set amount of time is a default amount of time fixed prior to the initiating the casino wagering game.

5. The gaming machine of claim 1, wherein the meter speed is equal to a delta money value, comprising the difference between the second jackpot value and the first jackpot value, divided by the set amount of time.

6. The gaming machine of claim 5, wherein the delta money value is an integer with units corresponding to the lowest denomination displayed in the progressive jackpot meter.

7. The gaming machine of claim 1, wherein the game-logic circuitry is further configured to receive a jackpot-increase signal indicating that the first jackpot value has increased to the second jackpot value, the determining the meter speed being in response to the receipt of the jackpot-increase signal.

8. The gaming machine of claim 1, wherein the progressive jackpot meter includes a row of juxtaposed meter positions, each of the meter positions displaying integers corresponding to a respective base-ten value of a monetary unit.

9. The gaming machine of claim 8, wherein each of the meter positions of the progressive jackpot meter is assigned a respective meter position number, the meter positions being numbered sequentially, starting at zero, from right-to-left, and wherein the controlled meter position is determined to be the meter position assigned meter position number N, where:

$$N=(\text{number of digit places in meter speed}-1).$$

10. The gaming machine of claim 9, wherein the first speed of scroll for the controlled meter position is calculated as:

$$\text{first speed of scroll} = \frac{\text{meter speed}}{(10\text{^ meter position number of controlled meter position})}.$$

11. The gaming machine of claim 9, wherein the respective speed of scroll for each of the meter positions to the right of the controlled meter position is calculated as:

$$\text{respective speed of scroll} = \frac{\text{meter speed}}{(10\text{^ meter position number of respective meter position})}.$$

12. The gaming machine of claim 1, wherein the game-logic circuitry is further configured to:

determine whether each of the respective speeds for each of the meter positions to the right of the controlled meter position is greater than a maximum allowable speed; and in response to one of the respective speeds of one of the meter positions to the right of the controlled meter position being greater than a maximum allowable speed, setting the respective speed equal to the maximum allowable speed minus a predetermined offset value.

13. The gaming machine of claim 1, wherein the increase from the first jackpot value to the second jackpot value is based, at least in part, on another physical input from the player as an indication of a wager to play the casino wagering game.

14. The gaming machine of claim 1, further including a value input device disposed on the gaming cabinet and used to fund the casino wagering game.

15. A gaming system for conducting a wagering game, the wagering game being associated with a progressive jackpot, the gaming system comprising:

an electronic gaming machine including a gaming cabinet, an electronic display device, and an electronic input device, the electronic display device and the electronic input device being attached to the gaming cabinet, the electronic input device being configured to receive an input from a player to initiate the wagering game, the electronic display device being configured to display aspects of the wagering game; and game-logic circuitry comprising one or more processors configured to:

initiate the wagering game in response to an electronic data signal received from the electronic input device responsive to the player input;

determine an outcome of the wagering game based, at least in part, on one or more random elements generated by one or more random element generators;

direct the electronic display device to display the outcome;

direct the electronic display device to display in a progressive jackpot meter a first jackpot value for the progressive jackpot;

determine a meter speed for the progressive jackpot meter to incrementally display the first jackpot value being increased to a second jackpot value within a set amount of time;

determine a controlled meter position from the meter speed;

determine a first speed of scroll for the controlled meter position;

determine a respective speed of scroll for each of the meter positions to the right of the controlled meter position, if any; and direct the electronic display device to display the progressive jackpot meter incrementally increasing to the second jackpot value as restricted by the first speed of scroll and any respective speeds of scroll.

16. The gaming system of claim 15, wherein the first speed of scroll for the controlled meter position is calculated as:

$$\text{first speed of scroll} = \frac{\text{meter speed}}{(10\hat{}\ \text{meter position number of controlled meter position})}.$$

17. The gaming system of claim 15, wherein the respective speed of scroll for each of the meter positions to the right of the controlled meter position is calculated as:

$$\text{respective speed of scroll} = \frac{\text{meter speed}}{(10\hat{}\ \text{meter position number of respective meter position})}.$$

18. The gaming system of claim 15, wherein the random element generator and the game-logic circuitry reside within the gaming cabinet.

19. The gaming system of claim 15, wherein the casino gaming machine includes a value input device disposed on the gaming cabinet and used to fund the casino wagering game.

20. A method of operating a gaming system, the gaming system including game-logic circuitry and an electronic gaming machine, the electronic gaming machine including a gaming cabinet with an electronic display device and an electronic input device coupled to the gaming cabinet, the game-logic circuitry including one or more processors, the method comprising:

receiving, by the electronic input device of the electronic gaming machine, a wager input from a player to initiate a casino wagering game, the casino wagering game being associated with a progressive jackpot;

generating one or more random elements with a electronic random element generator;

determining, via the game-logic circuitry, an outcome of the casino wagering game based, at least in part, on the one or more random elements;

displaying the outcome of the casino wagering game via the electronic display device of the electronic gaming machine;

displaying, via the electronic display device, a first jackpot value of the progressive jackpot in a progressive jackpot meter;

determining, via the game-logic circuitry, a meter speed for the progressive jackpot meter to incrementally display the first jackpot value being increased to a second jackpot value within a set amount of time;

determining, via the game-logic circuitry, a controlled meter position from the meter speed;

determining, via the game-logic circuitry, a first speed of scroll for the controlled meter position;

determining, via the game-logic circuitry, a respective speed of scroll for each of the meter positions to the right of the controlled meter position, if any;

displaying, via the electronic display device, the progressive jackpot meter incrementally increasing to the second jackpot value as restricted by the first speed of scroll and any respective speeds of scroll; and transmitting, via the game-logic circuitry, an indication of an award to the player in response to the outcome meeting a predetermined award criterion.

* * * * *